US010000997B2

(12) United States Patent
Tucker et al.

(10) Patent No.: US 10,000,997 B2
(45) Date of Patent: Jun. 19, 2018

(54) LONGITUDINAL POSITIONING TOOL FOR A ROD STRING

(71) Applicants: Shayne L. Tucker, Alberta (CA); Barton Toporowski, Lloydminster (CA); Perry Bateman, Lloydminster (CA); Wendall Elford, Lloydminster (CA); Glen Strunk, Lloydminster (CA)

(72) Inventors: Shayne L. Tucker, Alberta (CA); Barton Toporowski, Lloydminster (CA); Perry Bateman, Lloydminster (CA); Wendall Elford, Lloydminster (CA); Glen Strunk, Lloydminster (CA)

(73) Assignee: Safe-T-Tech Tools Ltd., Lloydminster (CA)

( * ) Notice: Subject to any disclaimer, the term of this patent is extended or adjusted under 35 U.S.C. 154(b) by 264 days.

(21) Appl. No.: 15/150,926

(22) Filed: May 10, 2016

(65) Prior Publication Data

US 2017/0074066 A1 Mar. 16, 2017

(30) Foreign Application Priority Data

Sep. 10, 2015 (CA) ..... 2903676

(51) Int. Cl.
*E21B 43/12* (2006.01)

(52) U.S. Cl.
CPC ..... *E21B 43/126* (2013.01)

(58) Field of Classification Search
CPC ... E21B 43/126; E21B 43/2406; F04D 29/445
See application file for complete search history.

(56) References Cited

U.S. PATENT DOCUMENTS

2014/0262259 A1* 9/2014 Fouillard ..... E21B 43/126 166/272.3

* cited by examiner

*Primary Examiner* — Brad Harcourt
(74) *Attorney, Agent, or Firm* — Ryan W. Dupuis; Ade + Company Inc.; Kyle R. Satterthwaite

(57) ABSTRACT

A rod positioning tool mounts in series between a tubing string and the stuffing box of a drive head. An outer mandrel of the tool mounts to a first flange at the bottom end for connection to the tubing string below and an inner mandral mounts to a second flange for connection to the stuffing box above. The inner mandrel is slidably received within the outer mandrel with primary seals therebetween to vary the overall length of the tool using one or more actuators between the flanges, while maintaining a sealed connection between the tubing string and the stuffing box. Keys on the outer tubular mandrel are longitudinally slidable in keyways on the inner tubular mandrel to resist relative rotation between the mandrels. A secondary seal provides a sealed connection between the second flange and the top end of the outer mandrel in a fully retracted position of the tool.

20 Claims, 7 Drawing Sheets

LONGITUDINAL POSITIONING TOOL FOR A ROD STRING

This application claims foreign priority benefits from Canadian Patent Application 2,903,676, filed Sep. 10, 2015.

FIELD OF THE INVENTION

The present invention relates to a tool arranged to support a rod string at different longitudinal positions relative to a tubing string while permitting the rod string to remain connected to a drive head so as to be rotatable relative to the tubing string at each of the different longitudinal positions.

BACKGROUND

Various types of downhole equipment (for example downhole pumps) at the bottom end of a tubing string are driven to rotate by rod string extending longitudinally through the tubing string. A bottom end of the rod string is coupled to the downhole equipment while a top end of the rod string is coupled to the rotary output of a drive head supported above the tubing string. The rod string is typically formed of a plurality of rods connected in series with one another, or in some instances a continuous rod is used. As the rod is rotated, the rod string typically comes into contact with an inner surface of the tubing string at various elevations which may wear through the tubing string at the points of contact. Accordingly it is desirable to reposition the elevation of the rod string relative to the tubing string to redistribute wear over a larger area of the tubing string by repositioning the points of contact relative to the length of the tubing.

SUMMARY OF THE INVENTION

According to one aspect of the invention there is provided a positioning tool for mounting in series between a tubing string therebelow and a stuffing box with a drive head thereabove for longitudinally positioning a rod string that is supported to rotate within the tubing string by the drive head, the tool comprising:

- a first flange arranged for sealed connection relative to one of the tubing string therebelow or the drive head thereabove;
- a second flange arranged for sealed connection relative to another one of the tubing string therebelow or the stuffing box thereabove;
- an outer tubular mandrel extending longitudinally between a first end of the outer tubular mandrel fixedly mounted in sealed connection to the first flange and an opposing second end of the outer tubular mandrel;
- an inner tubular mandrel extending longitudinally between a first end of the inner tubular mandrel and an opposing second end of the inner tubular mandrel that is fixedly mounted in sealed connection to the second flange;
- the first end of the inner tubular mandrel being received within the outer tubular mandrel such that the inner and outer tubular mandrels are longitudinally slidable relative to one another between an extended position defining a first overall length between the first and second flanges and a retracted position defining a second overall length between the first and second flanges which is reduced relative to the first overall length;
- at least one actuator operatively connected between the first and second flanges so as to drive longitudinal relative sliding of the inner and outer mandrels between the extended and retracted positions;
- a primary seal operatively connected between the inner tubular mandrel and the outer tubular mandrel in sliding engagement with at least one of the tubular mandrels so as to be arranged to maintain a sealed connection between the inner tubular mandrel and the outer tubular mandrel as the tubular mandrels are displaced relative to one another between the extended and retracted positions;
- at least one keyway formed to extend longitudinally along one of the inner and outer tubular mandrels; and
- a sliding key operatively associated with said at least one keyway that is fixedly mounted on another one of the inner and outer tubular mandrels so as to be longitudinally slidable within said at least one keyway between the extended and retracted positions of the tubular mandrels whereby the sliding key within said at least one keyway resists rotation of the inner tubular mandrel relative to the outer tubular mandrel.

The longitudinal positioning tool permits the longitudinal position of the rod string to be adjusted without affecting the normal operation of the drive head used to rotate the rod string. In this instance, the elevation of points of contact between the rod string and the tubing string can be adjusted periodically or continuously stroked so that the potential wear of the rod connections on the inner surface of the tubing string can be distributed over a larger area along the tubing string. The life of the tubing string before the rotating rod string wears through the tubing string can thus be considerably extended.

The tool can be fitted between any tubing string and stuffing box connection for use with various commercially available drives for rotating the rod.

The tool can also be used on vertical or horizontal wells.

In the illustrated embodiment, the first flange is coupled to the stuffing box and the second flange is coupled to the tubing string.

Preferably a plurality of keyways are supported on the inner mandrel at evenly spaced positions in the circumferential direction and corresponding sliding keys are supported on the outer mandrel in alignment with the keyways respectively. The sliding keys may be supported on a collar mounted in fixed relation to the respective tubular mandrel by an interlocking engagement between the collar and the tubular mandrel which resists relative rotation therebetween.

When the outer mandrel is coupled to the first flange by a threaded connection, preferably the tool further comprises at least one first key mounted on the first flange so as to be received within a respective slot on the outer mandrel to resist release of said threaded connection. Similarly, when the inner mandrel is coupled to the second flange by a threaded connection, preferably the tool further comprises at least one second key mounted on the second flange so as to be received within a respective keyway on the outer mandrel to resist release of said threaded connection.

Preferably the actuator comprises a plurality of hydraulic linear actuators at circumferentially spaced apart positions about the outer tubular mandrel, in which each hydraulic linear actuator is mounted to the first flange and the second flange at opposing ends of the actuator.

The primary seal is preferably supported in fixed connection about the inner tubular mandrel in proximity to the first end of the inner tubular mandrel so as to be slidably engaged with an inner surface of the outer tubular mandrel. An end cap may be threadably secured to the first end of the inner tubular mandrel such that the primary seal is longitudinally restricted between the end cap and a shoulder formed on an outer surface of the inner tubular mandrel.

When i) the outer tubular mandrel has a main passage extending longitudinally through the outer tubular mandrel that slidably receives the inner tubular mandrel therein and that has a first prescribed diameter, and ii) the inner tubular mandrel has a main passage extending longitudinally through the inner tubular mandrel that has a second prescribed diameter, preferably iii) a frusto-conical portion is located at the first end of the inner tubular mandrel which is gradually increased in diameter in a longitudinal direction towards the first end of the outer tubular mandrel from the second prescribed diameter to the first prescribed diameter.

When the outer tubular mandrel has i) a main passage extending longitudinally through the outer tubular mandrel that slidably receives the inner tubular mandrel therein and that has a first prescribed diameter, and ii) an end passage at the first end of the outer tubular mandrel having a second prescribed diameter which is reduced relative to the first prescribed diameter, preferably there is also provided iii) a frusto-conical portion between the main passage and the end passage which is gradually decreased in diameter in a longitudinal direction towards the first end of the outer tubular mandrel from the first prescribed diameter to the second prescribed diameter.

In some instances, a secondary seal may be supported in fixed relation to one of the inner and outer tubular mandrels and providing a sealed connection between the inner and outer tubular mandrels only in the retracted position of the tubular mandrels.

According to a second aspect of the present invention there is provided a positioning tool for mounting in series between a tubing string therebelow and a stuffing box with a drive head thereabove for longitudinally positioning a rod string that is supported to rotate within the tubing string by the drive head, the tool comprising:

- a first flange arranged for sealed connection relative to one of the tubing string therebelow or the drive head thereabove;
- a second flange arranged for sealed connection relative to another one of the tubing string therebelow or the stuffing box thereabove;
- an outer tubular mandrel extending longitudinally between a first end of the outer tubular mandrel fixedly mounted in sealed connection to the first flange and an opposing second end of the outer tubular mandrel;
- an inner tubular mandrel extending longitudinally between a first end of the inner tubular mandrel and an opposing second end of the inner tubular mandrel that is fixedly mounted in sealed connection to the second flange;
- the first end of the inner tubular mandrel being received within the outer tubular mandrel such that the inner and outer tubular mandrels are longitudinally slidable relative to one another between an extended position defining a first overall length between the first and second flanges and a retracted position defining a second overall length between the first and second flanges which is reduced relative to the first overall length;
- at least one actuator operatively connected between the first and second flanges so as to drive longitudinal relative sliding of the inner and outer mandrels between the extended and retracted positions;
- a primary seal operatively connected between the inner tubular mandrel and the outer tubular mandrel in sliding engagement with at least one of the tubular mandrels so as to be arranged to maintain a sealed connection between the inner tubular mandrel and the outer tubular mandrel as the tubular mandrels are displaced relative to one another between the extended and retracted positions;
- a second seal supported in fixed relation to one of the inner and outer tubular mandrels and providing a sealed connection between the inner and outer tubular mandrels only in the retracted position of the tubular mandrels.

In the event that the primary seal fails resulting in oil leakage to the exterior of the mandrels, the positioning tool as described above can be fully retracted to provide a proper secondary seal that restricts oil leakage. The well head can thus still be producing oil without having to shut it completely down. This would give an operator time to schedule repairs before having to completely shut it off.

Preferably the secondary seal is engaged between the second flange and the second end of the outer tubular mandrel in the retracted position. More preferably, the secondary seal is supported in fixed relation to the inner tubular mandrel for engagement by the outer tubular mandrel only in the retracted position.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 2:
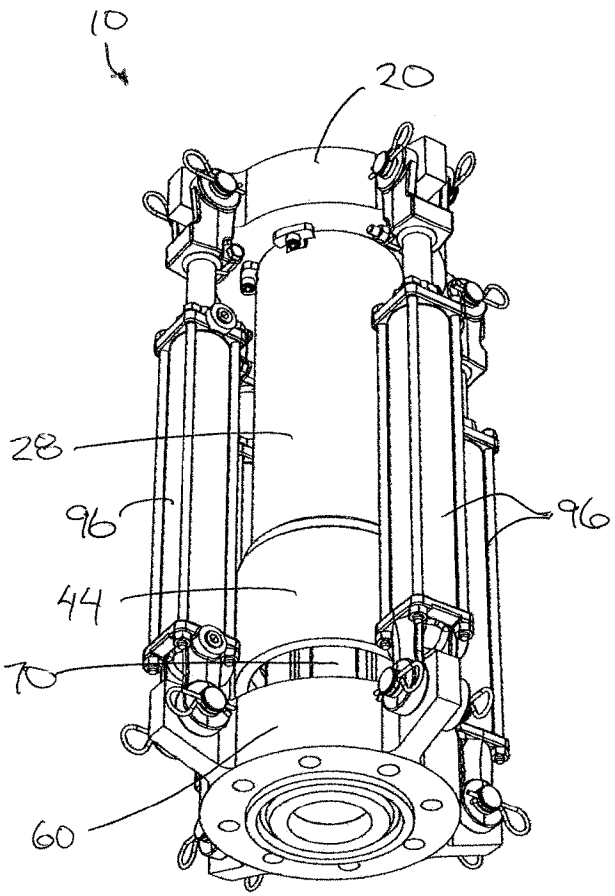
FIG. 2 is a perspective view of the positioning tool showing a bottom side of the tool.
Figure 1:
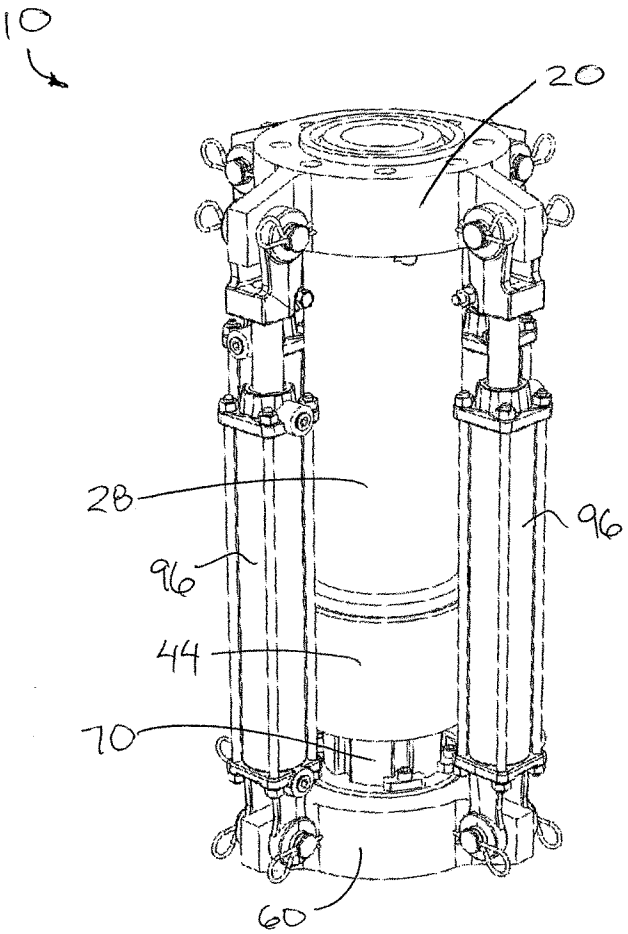
FIG. 1 is a perspective view of the positioning tool showing a top side of the tool.
Figure 3:
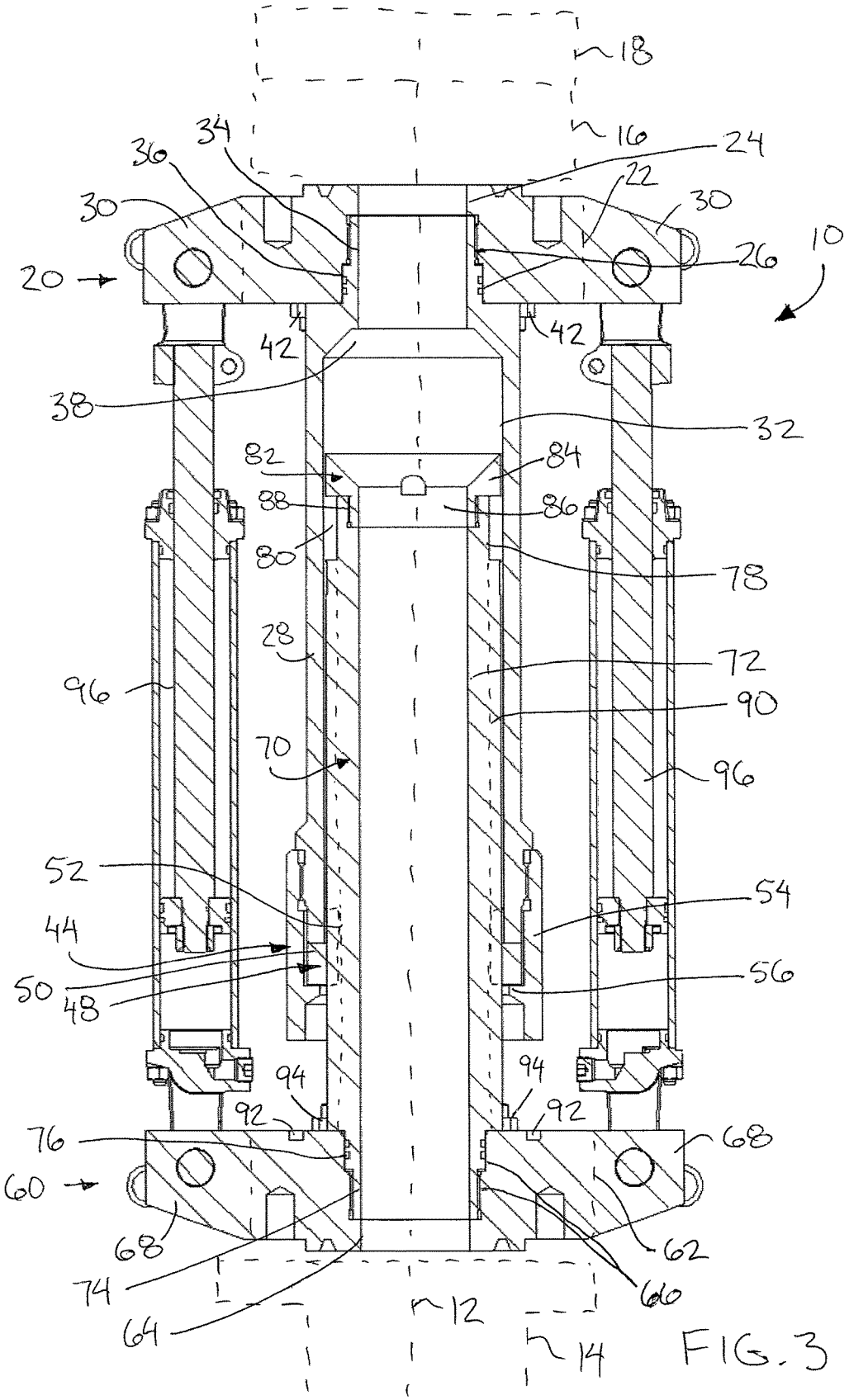
FIG. 3 is a longitudinal cross-section of the positioning tool.
Figure 4:
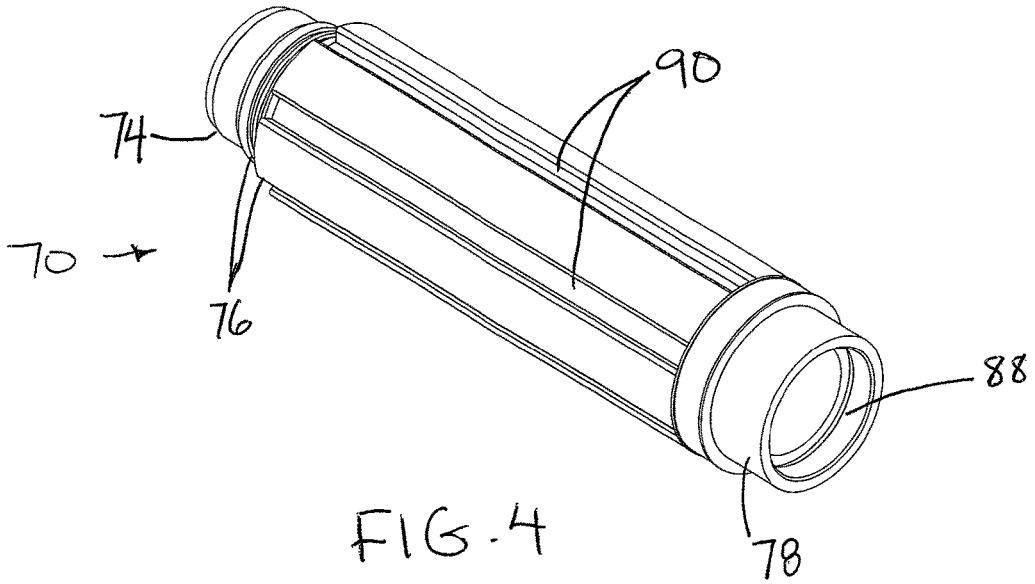
FIG. 4 is a perspective view of the inner mandrel of the tool.
Figure 5:
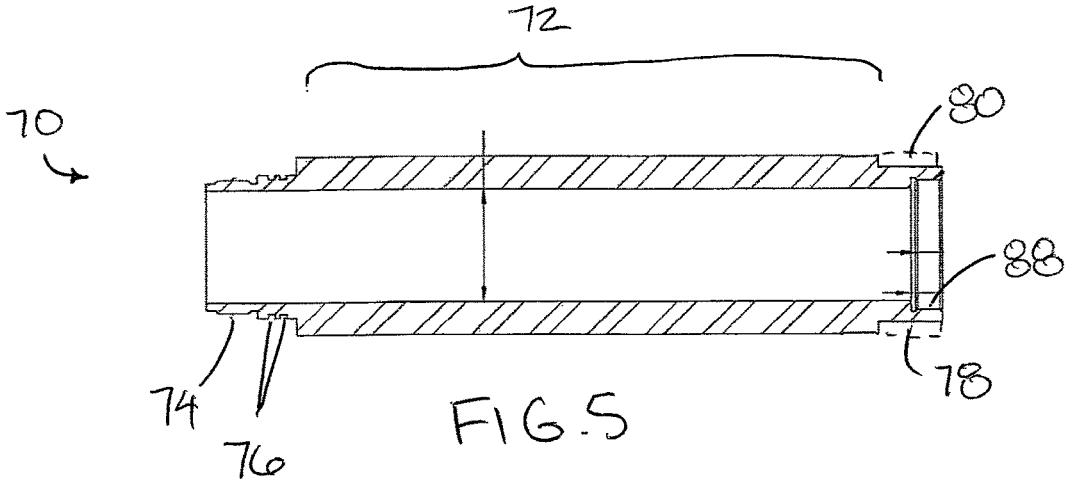
FIG. 5 is a longitudinal cross-section of the inner mandrel.
Figure 6:
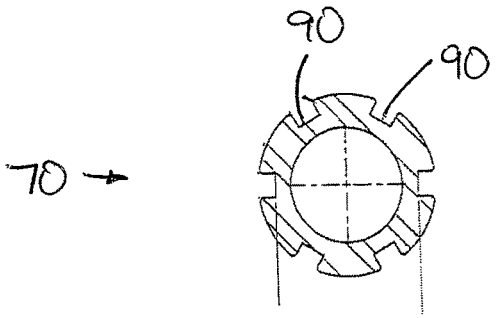
FIG. 6 is a transverse cross-section of the inner mandrel.
Figure 7:
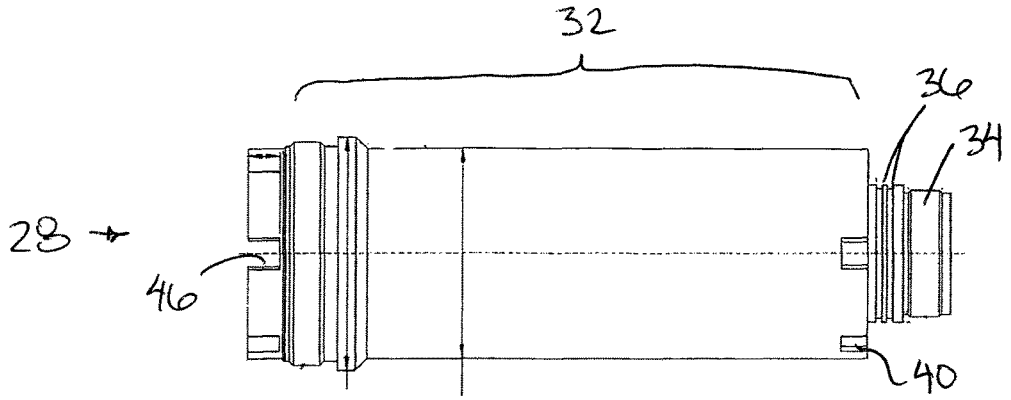
FIG. 7 is a side elevational view of the outer mandrel of the tool.
Figure 8:
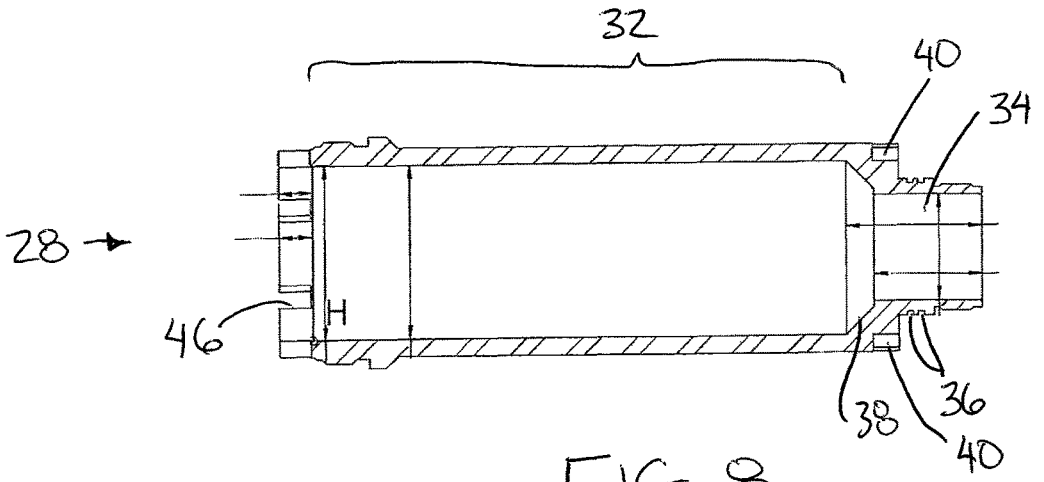
FIG. 8 is a longitudinal cross-section of the outer mandrel.
Figure 9:
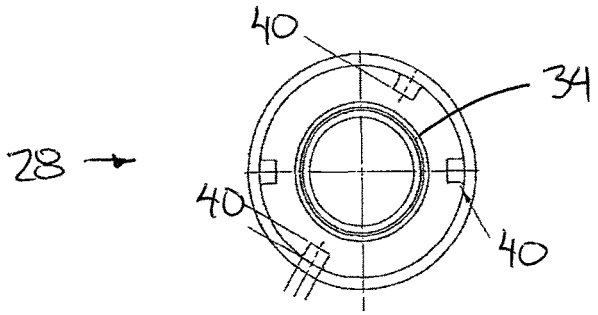
FIG. 9 is a bottom end view of the outer mandrel.
Figure 10:
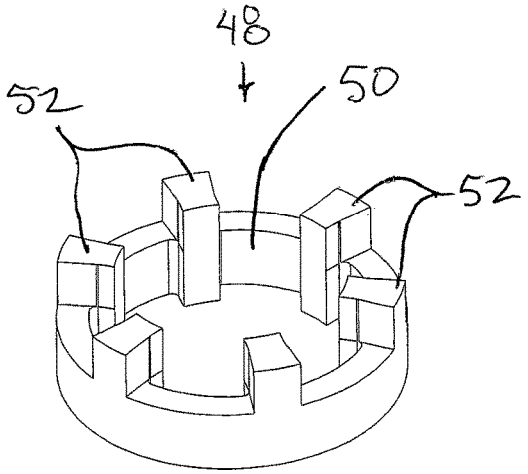
FIG. 10 is a perspective view of the sliding key body of the tool.
Figure 11:
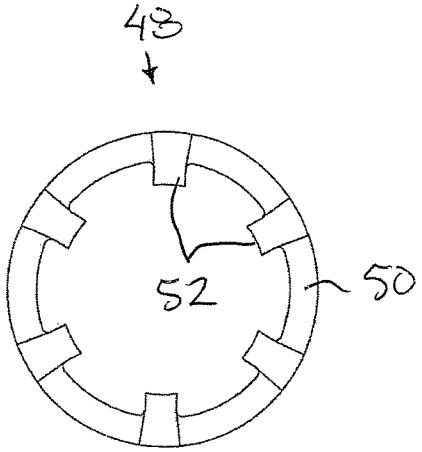
FIG. 11 is an end view of the sliding key body.
Figure 12:
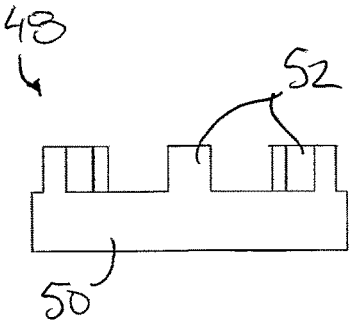
FIG. 12 is a side view of the sliding key body.
Figure 13:
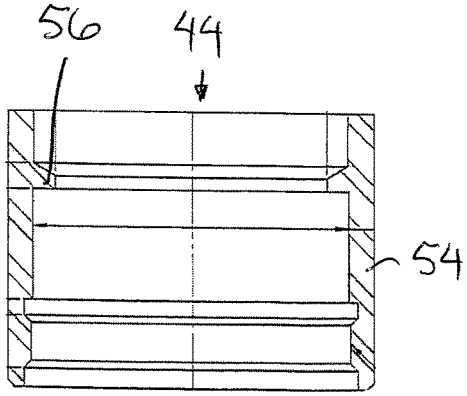
FIG. 13 is a longitudinal cross-section of a first retainer body for retaining the sliding key body at the end of the outer mandrel.
Figure 14:
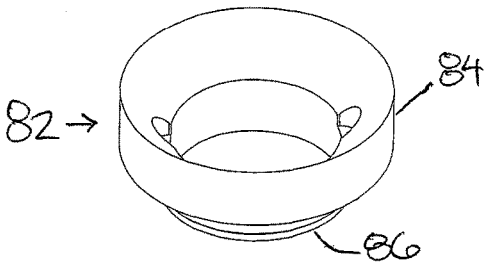
FIG. 14 is a perspective view of a second retainer body for retaining a primary seal at the bottom end of the inner mandrel of the tool.
Figure 15:
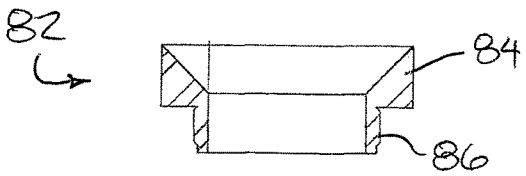
FIG. 15 is a longitudinal cross-section of the second retainer body.
Figure 16:
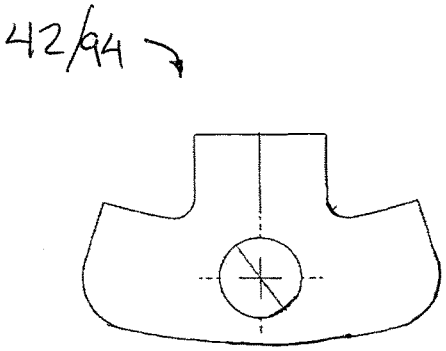
FIG. 16 is a plan view of a locking key for fixing each mandrel to the respective flange of the tool.
Figure 17:
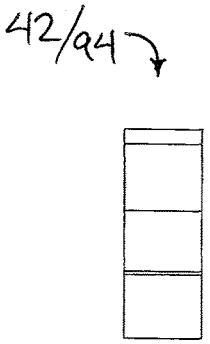
FIG. 17 is an end view of the locking key of FIG. 16.
Figure 18:
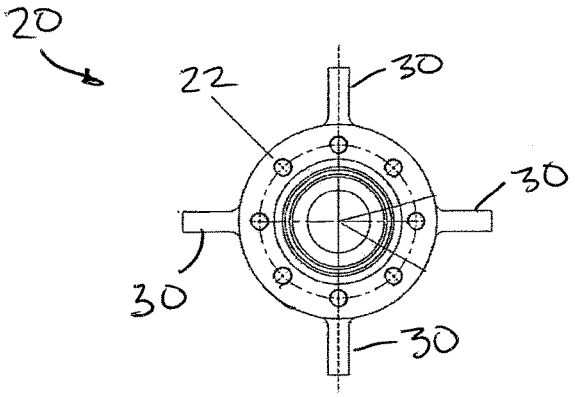
FIG. 18 is an end view of the bottom flange of the tool.
Figure 19:
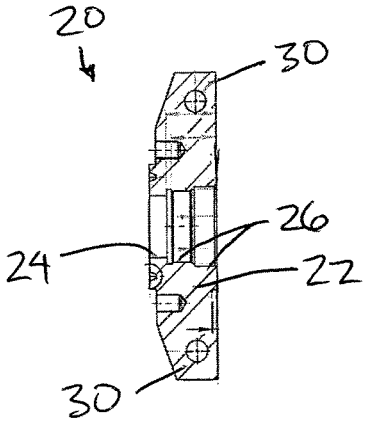
FIG. 19 is a longitudinal cross-section of the bottom flange.
Figure 20:
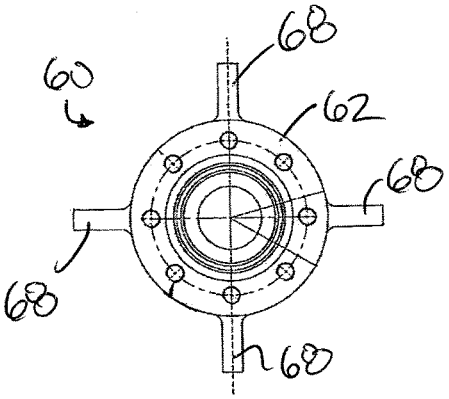
FIG. 20 is an end view of the top flange of the tool.
Figure 21:
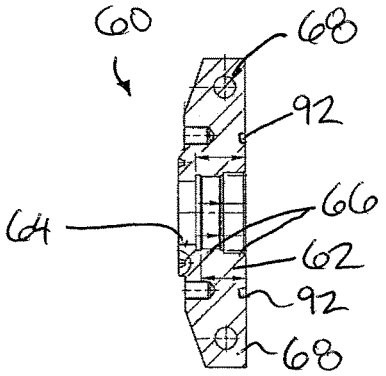
FIG. 21 is a longitudinal cross-section of the top flange.

Referring to the accompanying figures there is illustrated a longitudinal positioning tool generally indicated by reference numeral 10. The tool 10 is particularly suited for use in longitudinally positioning a rod string 12 relative to a tubing string 14.

Typically the tubing string 14 is suspended down hole from a well head which includes a stuffing box 16 and a drive head 18 above the stuffing box. The rod string 12 is suspended from the drive head to extend through the stuffing box and be suspended within the tubing string. The rod string is driven to rotate by the drive head to transfer rotation from the drive head to the rotor of a progressive cavity pump connected to the bottom end thereof. The stator of the pump is in turn suspended in series with the tubing string 14. The tool 10 is connected in series between the tubing string therebelow and the stuffing box thereabove such that adjusting the overall length of the tool in the longitudinal direction of the tubing string causes the height of the stuffing box and drive head relative to the tubing string therebelow to be adjusted. Accordingly the longitudinal position of the rod string is effectively adjusted relative to the tubing string within which it is received.

The tool 10 includes a first flange body 20 at the top end thereof for forming a sealed connection to the stuffing box above. The first flange body includes a collar portion 22 having an annular end face with a plurality of circumferentially spaced fastener apertures formed therein for forming a fastened connection to a suitable fastener flange of the stuffing box. A central bore 24 extends through the first flange body for alignment with the passage of the tubing string and stuffing box.

At the inner or bottom side of the body 20 the central bore 24 has an internal diameter which is stepped outwardly by two counterbores 26 in which the innermost counterbore is internally threaded for forming a threaded connection with an outer mandrel 28 as described in further detail below.

The first flange body 20 further includes four radially extending mounting arms 30 at evenly spaced apart positions in the circumferential direction which extend outwardly for connection to components of a lift mechanism as described in further detail below.

The outer mandrel 28 comprises a tubular body which is elongate in the longitudinal direction of the tubing string. The mandrel includes a main portion 32 having an inner diameter corresponding to a first prescribed diameter which is greater than the inner diameter of the passage through the flange body so as to be similarly greater than the passage of the tubing string.

The outer mandrel 28 also includes a top end portion 34 which is stepped so as to be reduced in outer diameter in two stages corresponding to the stepped inner diameter at the top side of the first flange body 20. The uppermost portion of the top end portion 34 of smallest outer diameter is externally threaded for forming a threaded connection with the corresponding threaded portion of the counterbore within the first flange body 20. The intermediate portion of the bottom end portion 34 includes at least one groove formed therein for receiving an O-ring 36 for sealed engagement between the top end portion of the outer mandrel and the surrounding counterbore of the first flange body 20.

The interior diameter of the top end portion 34 is reduced relative to the main portion so as to correspond to a second prescribed inner diameter which is approximately equal to the inner diameter of the central bore passage in the flange body 20. A frustoconical transition 38 is provided within the interior of the outer mandrel 28 between the main portion 32 and the reduced diameter top end portion 34 where the inner diameter is gradually reduced in the longitudinal direction from the first prescribed diameter of the main portion to the second prescribed diameter thereabove.

A plurality of locking slots 40 are provided in the outer surface of the outer mandrel 28 in proximity to the top end thereof so as to be directly adjacent the bottom or inner surface of the first flange body 20 in the mounted position of the outer mandrel to the first flange body 20. A plurality of locking keys 40 are provided to provide a positive locked connection between the outer mandrel and the first flange body 20 once they are fully threaded together in sealed connection. Each locking key includes a flange portion with a fastener aperture therein so as to be permitted to be fastened against the inner surface of the first flange body 20 and a key portion within the plane of the flange portion which is sized to snugly fit within a respective one of the locking slots 40 in the outer surface of the outer mandrel 28.

The inner or bottom end of the outer mandrel 28 is externally threaded for threaded connection to a first retainer body 44 as described in further detail below. An inner end portion of the outer mandrel 28 extending longitudinally beyond the external threaded portion includes a plurality of slots 46 formed therein. The slots are evenly spaced in the circumferential direction relative to one another and extend longitudinally inward into the body from the outer end face of the body of the outer mandrel. Each slot communicates fully through the wall of the mandrel in the radial direction from the inner surface to the outer surface thereof.

A key body 48 is mounted at the inner end of the outer mandrel 28 for cooperation with the slots 46 described above. The key body includes a collar portion 50 which abuts the outermost end face of the bottom end of the outer mandrel, having an inner diameter and an outer diameter corresponding to the inner and outer diameter of the main portion of the outer mandrel. A plurality of sliding keys 52 are mounted on the collar portion 50 at evenly spaced apart positions in the circumferential direction for alignment with respective ones of the slots 46 at the inner end of the outer mandrel. Accordingly each sliding key 52 extends longitudinally inward from the inner annular end face of the collar portion for protruding longitudinally inward into a respective one of the slots 46 which snugly receives the sliding key therein. Each sliding key 52 also extends radially inward beyond the inner diameter of the collar portion 50 along the full longitudinal height of the keys protruding longitudinally from the collar portion as well as the full height of the collar portion 50 itself. Each sliding key thus protrudes radially inward along the full height thereof which corresponds to the longitudinal height of the collar portion 50 together with the longitudinal length of the slots 46 receiving the keys therein.

The first retainer body 44 serves to retain the key body 48 abutted at the inner end of the outer mandrel. The first retainer body includes a collar portion 54 having an interior diameter which fits over the outer diameter of the outer mandrel and the outer diameter of the key body 48. An inner or top end of the retainer body collar portion 54 is internally threaded for forming a threaded connection to the externally threaded portion at the inner end of the outer mandrel 28. The first retainer body 44 further includes a flange portion 56 which is annular and extends radially inward from an inner surface of the collar portion 54 to an inner diameter of the flange portion which corresponds approximately to the first prescribed diameter which is the inner diameter of the key body 48 and the inner diameter of the main portion of the outer mandrel 28. The flange portion 56 abuts the outer end of the key body for retaining the key body clamped between the flange portion 56 and the inner end of the outer mandrel as the first retainer body 44 is threaded onto the outer mandrel. The flange portion 56 is proximate the outer end of the first retainer body however a portion of the collar portion 54 protrudes longitudinally outward beyond the flange portion at a position which is radially outward from the first prescribed diameter.

The tool further includes a second flange body 60 at the bottom end thereof which is substantially identical to the first flange body 20 at the top end. Accordingly the second flange body 60 includes a collar portion 62 having an annular end face with circumferentially spaced apart fastener apertures therein for forming a threaded connection to a suitable flange of the tubing string below. A central bore 64 within the second flange body 60 corresponds to the second prescribed diameter and is aligned with the passage of the tubing string. The internal diameter of the second flange body 60 is stepped outwardly at the inner or top side thereof by two counterbores 66 in which the innermost counter bore 66 of smallest diameter is internally threaded. The second flange body 60 also includes four mounting arms 68 extending radially outward from the collar 62 at evenly spaced apart positions in the circumferential direction for alignment with respective ones of the mounting arms of the first flange body 20 as described in further detail below.

An inner mandrel 70 is provided for forming a threaded connection to the second flange body 60 in the same manner as the threaded connection between the outer mandrel 28 and the first flange body 20. The inner mandrel 70 includes a main portion 72 having an outer diameter corresponding to the first prescribed diameter so as to be receivable within the interior of the outer mandrel 28, and an inner diameter which corresponds to the second prescribed diameter.

A bottom end portion 74 of the inner mandrel is stepped to be reduced in outer diameter to form a collar which is stepped in outer diameter corresponding to the stepped profile of the counterbores 66 of the second flange body 60. The outermost portion of the bottom end portion 74 of smallest diameter is externally threaded for forming a threaded connection within the corresponding counterbore 66 of the second flange body 60. Annular grooves are provided in the intermediate portion of the top end portion 74 for receiving O-rings 76 therein which form a sealed connection with the corresponding intermediate counter bore of the second flange body 60 when the inner mandrel 70 is threaded into the second flange body 60.

The inner mandrel also includes a top end portion 78 having an outer diameter which is reduced to define an annular cavity which receives a primary packing seal 80 therein. The stepped outer diameter forms a shoulder on the outer surface of the inner mandrel which abuts the inner end of the packing seal 80. The packing seal 80 occupies the full length of the annular cavity in the longitudinal direction between the shoulder and a second retainer body 82 at the end of the inner mandrel, while also occupying the full radial dimension of the cavity between the top end portion 78 and the surrounding inner diameter of the main portion of the outer mandrel 28 in the assembled position of the inner mandrel received within the outer mandrel.

The second retainer body 82 is provided for threaded mounting onto the inner or bottom end of the inner mandrel 70. The second retainer body 82 has an upper portion 84 with an outer diameter corresponding to the first prescribed diameter, that is the inner diameter of the main portion of the outer mandrel 28. An annular end face at the inner end of the upper portion 84 abuts the end of the inner mandrel end protrudes radially therefrom for closing the top end of the annular cavity receiving the packing seal 80 therein. The second retainer body 82 further includes a lower portion 86 which is reduced in outer diameter relative to the upper portion so as to be received within an internal counter bore 88 at the inner or top end of the inner mandrel 70. A threaded connection is formed between the outer diameter of the lower portion 86 and the inner surface of the counter bore 88 at the top end of the inner mandrel. The inner diameter of the second retainer body 82 at the lower portion corresponds to the second prescribed diameter, that is the interior diameter of the inner mandrel. The inner diameter of the upper portion 84 of the second retainer body comprises a frustoconical surface which gradually increases in inner diameter from the second prescribed diameter of the lower portion therebelow to the first prescribed diameter of the remainder of the main portion of the outer mandrel thereabove in a longitudinal downward direction towards the first flange body 20.

The main portion of the inner mandrel includes a plurality of keyways 90 formed therein in the form of longitudinally extending slots in the outer surface which extend the full height of the main portion in the longitudinal direction between the top end portion and the bottom end portion of the inner mandrel. The keyways are provided at evenly spaced apart positions in the circumferential direction for alignment with corresponding ones of the sliding keys 52 of the key body 48.

In a mounted position, the inner mandrel is longitudinally slidable within the outer mandrel with the sliding keys being longitudinally slidable within respective keyways of the inner mandrel between an extended position of the mandrels and a retracted position of the mandrels. The extended position corresponds to the top end of the inner mandrel being near the bottom end of the outer mandrel and the keys of the outer mandrel being located at the top end of the keyways in the inner mandrel. The retracted position corresponds to the top end of the inner mandrel being adjacent the top end of the outer mandrel such that the bottom end of the first retainer body 44 is abutted against the inner or top face of the collar portion of the second flange body 60. The retracted position corresponds to the minimum overall height between the first and second flange bodies whereas the extended position corresponds to the maximum overall height between the first and second flange bodies.

An annular groove 92 is provided in the inward facing end face of the second flange body 60 having a radius corresponding to the radius of the collar portion of the first retainer body 44. An O-ring is received within the annular groove 92 for abutment with the first retainer body 44 in the retracted position to form a sealed connection between the second flange body 60 and the first retainer body 44 in the retracted position. Additional O-rings may provide a sealed connection between the inner diameter of the first retainer body 44 and the outer diameter of the outer mandrel 28 to further ensure a sealed connection from the first retainer body 44 to the outer mandrel. Accordingly in the retracted position, the O-ring seal within the annular groove 92 in the second flange body 60 provides suitable sealing between the tubing string below the tool and the stuffing box above the tool without relying on the primary seal in the event that the primary packing seal 80 fails.

Additional locking keys 94 are provided which are identical to the locking keys 42 for being fastened to the inner or top surface of the second flange body 60 such that the key portion of each locking key 94 is received within a respective one of the keyways in the inner mandrel to thereby prevent relative rotation between the inner mandrel and the second flange body 60 for retaining the inner mandrel in a mounted position relative to the second flange body 60.

Displacement of the mandrels relative to one another between the extended and retracted positions is accomplished by a lift mechanism comprises of four actuators 96 comprising linear, hydraulic, piston/cylinder actuators. Each actuator 96 is mounted parallel to the longitudinal axis of the mandrels at evenly circumferentially spaced apart positions about the outer mandrel. Each actuator is coupled between one of the mounting arms 30 of the first flange body 20 at the top end thereof and one of the mounting arms 68 of the second flange body 60 at the bottom end thereof. Suitable hydraulics are connected to the actuators for extending and retracting the actuators simultaneously in unison relative to one another between the extended and retracted positions of the tool.

The tool is initially assembled by retaining the packing seal 80 about the top end of the inner mandrel by securing the second retainer body 82 at the top or inner end of the inner mandrel. The inner mandrel is then inserted through the bottom end of the outer mandrel with the key body 48 and the first retainer body then being secured to the inner/bottom end of the outer mandrel such that the keys of the key body 48 are slidably received within respective ones of the keyways of the inner mandrel. The first flange body 20 can then be secured to the top end of the outer mandrel by threaded and sealed connection with locking keys 42 to retain them in the mounted position, followed by threaded and sealed connection of the second flange body 60 to the bottom end of the inner mandrel 70 together with locking keys 94 to retain the mounted relationship therebetween. The four actuators 96 can then be connected between the first and second flange bodies. The assembled tool 10 can then be mounted in series between a tubing string therebelow and the stuffing box of a drive head thereabove such that the rod string extends downwardly through the tool 10 as it is suspended within the tubing string.

In operation, the actuators 96 may be actuated to continuously longitudinally stroke between extended and retracted positions for longitudinally stroking the rod string relative to the tubing string. Alternatively the actuators 96 may be only periodically activated in incremental displacements between the extended and retracted positions as the rod string is continuously rotated so as to merely periodically longitudinally reposition the rod string relative to the tubing string.

Since various modifications can be made in my invention as herein above described, it is intended that all matter contained in the accompanying specification shall be interpreted as illustrative only and not in a limiting sense.

The invention claimed is:

1. A positioning tool for mounting in series between a tubing string therebelow and a stuffing box with a drive head thereabove for longitudinally positioning a rod string that is supported to rotate within the tubing string by the drive head, the tool comprising:

a first flange arranged for sealed connection relative to one of the tubing string therebelow or the drive head thereabove;

a second flange arranged for sealed connection relative to another one of the tubing string therebelow or the stuffing box thereabove;

an outer tubular mandrel extending longitudinally between a first end of the outer tubular mandrel fixedly mounted in sealed connection to the first flange and an opposing second end of the outer tubular mandrel;

an inner tubular mandrel extending longitudinally between a first end of the inner tubular mandrel and an opposing second end of the inner tubular mandrel that is fixedly mounted in sealed connection to the second flange;

the first end of the inner tubular mandrel being received within the outer tubular mandrel such that the inner and outer tubular mandrels are longitudinally slidable relative to one another between an extended position defining a first overall length between the first and second flanges and a retracted position defining a second overall length between the first and second flanges which is reduced relative to the first overall length;

at least one actuator operatively connected between the first and second flanges so as to drive longitudinal relative sliding of the inner and outer mandrels between the extended and retracted positions;

a primary seal operatively connected between the inner tubular mandrel and the outer tubular mandrel in sliding engagement with at least one of the tubular mandrels so as to be arranged to maintain a sealed connection between the inner tubular mandrel and the outer tubular mandrel as the tubular mandrels are displaced relative to one another between the extended and retracted positions;

at least one keyway formed to extend longitudinally along one of the inner and outer tubular mandrels; and a sliding key operatively associated with said at least one keyway that is fixedly mounted on another one of the inner and outer tubular mandrels so as to be longitudinally slidable within said at least one keyway between the extended and retracted positions of the tubular mandrels whereby the sliding key within said at least one keyway resists rotation of the inner tubular mandrel relative to the outer tubular mandrel.

2. The tool according to claim 1 wherein said at least one keyway is supported on the inner mandrel and the sliding key of said at least one keyway is supported on the outer mandrel.

3. The tool according to claim 1 wherein said at least one keyway comprises a plurality of keyways, each receiving a sliding key longitudinally slidable therein.

4. The tool according to claim 3 wherein the plurality of keyways are evenly spaced apart from one another in a circumferential direction about the tubular mandrels.

5. The tool according to claim 1 wherein the sliding key of said at least one keyway is supported on a collar mounted in fixed relation to the respective tubular mandrel by an interlocking engagement between the collar and the tubular mandrel which resists relative rotation therebetween.

6. The tool according to claim 1 wherein the outer mandrel is coupled to the first flange by a threaded connection and wherein the tool further comprises at least one first key mounted on the first flange so as to be received within a respective slot on the outer mandrel to resist release of said threaded connection.

7. The tool according to claim 1 wherein the inner mandrel is coupled to the second flange by a threaded connection and wherein the tool further comprises at least one second key mounted on the second flange so as to be received within a respective keyway on the outer mandrel to resist release of said threaded connection.

8. The tool according to claim 1 in combination with the tubing string and the stuffing box wherein the first flange is coupled to the stuffing box and the second flange is coupled to the tubing string.

9. The tool according to claim 1 wherein said at least one actuator comprises a plurality of hydraulic linear actuators at circumferentially spaced apart positions about the outer tubular mandrel, each hydraulic linear actuator being mounted to the first flange and the second flange at opposing ends of the actuator.

10. The tool according to claim 1 wherein the primary seal is supported in fixed connection about the inner tubular mandrel in proximity to the first end of the inner tubular mandrel so as to be slidably engaged with an inner surface of the outer tubular mandrel.

11. The tool according to claim 10 further comprising an end cap threadably secured to the first end of the inner tubular mandrel, wherein the primary seal is longitudinally restricted between the end cap and a shoulder formed on an outer surface of the inner tubular mandrel.

12. The tool according to claim 1 wherein:

i) the outer tubular mandrel has a main passage extending longitudinally through the outer tubular mandrel that slidably receives the inner tubular mandrel therein and that has a first prescribed diameter, ii) the inner tubular mandrel has a main passage extending longitudinally through the inner tubular mandrel that has a second prescribed diameter, and iii) a frusto-conical portion is located at the first end of the inner tubular mandrel which is gradually increased in diameter in a longitudinal direction towards the first end of the outer tubular mandrel from the second prescribed diameter to the first prescribed diameter.

13. The tool according to claim 1 wherein the outer tubular mandrel has i) a main passage extending longitudinally through the outer tubular mandrel that slidably receives the inner tubular mandrel therein and that has a first prescribed diameter, ii) an end passage at the first end of the outer tubular mandrel having a second prescribed diameter which is reduced relative to the first prescribed diameter, and iii) a frusto-conical portion between the main passage and the end passage which is gradually decreased in diameter in a longitudinal direction towards the first end of the outer tubular mandrel from the first prescribed diameter to the second prescribed diameter.

14. The tool according to claim 1 further comprising a secondary seal supported in fixed relation to one of the inner and outer tubular mandrels and providing a sealed connection between the inner and outer tubular mandrels only in the retracted position of the tubular mandrels.

15. The tool according to claim 14 wherein the secondary seal is engaged between the second flange and the second end of the outer tubular mandrel in the retracted position.

16. The tool according to claim 14 wherein the secondary seal is supported in fixed relation to the inner tubular mandrel for engagement by the outer tubular mandrel only in the retracted position.

17. A positioning tool for mounting in series between a tubing string therebelow and a stuffing box with a drive head thereabove for longitudinally positioning a rod string that is supported to rotate within the tubing string by the drive head, the tool comprising:

a first flange arranged for sealed connection relative to one of the tubing string therebelow or the drive head thereabove;

a second flange arranged for sealed connection relative to another one of the tubing string therebelow or the stuffing box thereabove;

an outer tubular mandrel extending longitudinally between a first end of the outer tubular mandrel fixedly mounted in sealed connection to the first flange and an opposing second end of the outer tubular mandrel;

an inner tubular mandrel extending longitudinally between a first end of the inner tubular mandrel and an opposing second end of the inner tubular mandrel that is fixedly mounted in sealed connection to the second flange;

the first end of the inner tubular mandrel being received within the outer tubular mandrel such that the inner and outer tubular mandrels are longitudinally slidable relative to one another between an extended position defining a first overall length between the first and second flanges and a retracted position defining a second overall length between the first and second flanges which is reduced relative to the first overall length;

at least one actuator operatively connected between the first and second flanges so as to drive longitudinal relative sliding of the inner and outer mandrels between the extended and retracted positions;

a primary seal operatively connected between the inner tubular mandrel and the outer tubular mandrel in sliding engagement with at least one of the tubular mandrels so as to be arranged to maintain a sealed connection between the inner tubular mandrel and the outer tubular mandrel as the tubular mandrels are displaced relative to one another between the extended and retracted positions;

a second seal supported in fixed relation to one of the inner and outer tubular mandrels and providing a sealed connection between the inner and outer tubular mandrels only in the retracted position of the tubular mandrels.

18. The tool according to claim 17 wherein the secondary seal is engaged between the second flange and the second end of the outer tubular mandrel in the retracted position.

19. The tool according to claim 17 wherein the secondary seal is supported in fixed relation to the inner tubular mandrel for engagement by the outer tubular mandrel only in the retracted position.

20. The tool according to claim 17 in combination with the tubing string and the stuffing box wherein the first flange is coupled to the stuffing box and the second flange is coupled to the tubing string.

* * * * *